United States Patent [19]

Ikegami

[11] Patent Number: 5,008,868

[45] Date of Patent: Apr. 16, 1991

[54] STRUCTURE FOR MOUNTING AN INTEGRATED CIRCUIT

[75] Inventor: Toshimasa Ikegami, Suwa, Japan

[73] Assignee: Seiko Epson Corporation, Tokyo, Japan

[21] Appl. No.: 164,299

[22] Filed: Mar. 4, 1988

[30] Foreign Application Priority Data

| | | | |
|---|---|---|---|
| Mar. 5, 1987 | [JP] | Japan | 62-50584 |
| Nov. 6, 1987 | [JP] | Japan | 62-280502 |
| Nov. 6, 1987 | [JP] | Japan | 62-169704 |

[51] Int. Cl.[5] ..... G04C 23/00; G04B 37/00

[52] U.S. Cl. ..... 368/88; 368/87

[58] Field of Search ..... 368/88, 87, 76–86, 368/327, 316

[56] References Cited

U.S. PATENT DOCUMENTS

| | | | |
|---|---|---|---|
| 3,698,073 | 10/1972 | Helda | 29/577 |
| 3,747,327 | 12/1973 | Uchiyama . | |
| 3,777,365 | 12/1973 | Umbaugh | 29/591 |
| 3,942,854 | 3/1976 | Klein et al. | 339/17 |
| 4,351,040 | 9/1982 | Aoki | 368/88 |
| 4,405,242 | 9/1983 | Kosaka et al. | 368/88 |
| 4,460,281 | 2/1984 | Othenin-Girard . | |
| 4,478,524 | 10/1984 | Saitoh et al. | 368/88 |

FOREIGN PATENT DOCUMENTS

| | | |
|---|---|---|
| 1021066 | 11/1977 | Canada . |
| 0145327 | 6/1985 | European Pat. Off. . |
| 2165418 | 7/1971 | Fed. Rep. of Germany . |
| 2449739 | 4/1976 | Fed. Rep. of Germany . |
| 7518118 | 5/1976 | France . |
| 830058 | 2/1983 | PCT Int'l Appl. . |
| 638368G | 9/1983 | Switzerland . |
| 1588527 | 7/1977 | United Kingdom . |
| 2090055 | 6/1982 | United Kingdom . |
| 2114821 | 8/1983 | United Kingdom . |
| 2125584 | 3/1984 | United Kingdom . |
| 2149980 | 6/1985 | United Kingdom . |

*Primary Examiner*—Bernard Roskoski

*Attorney, Agent, or Firm*—Blum Kaplan

[57] ABSTRACT

A structure for mounting an integrated circuit chip within a timepiece is provided. An insulating circuit substrate supporting a circuit pattern thereon having terminal portions formed on the substrate is mounted on a frame. An IC chip is mounted on the circuit substrate so that the terminals of the IC chip are in facing relationship with the circuit terminal portions. A circuit cover is mounted on the frame over the IC chip and circuit substrate and biases one of the IC chip or circuit terminal portions towards each other so that the chip terminals come into conductive contact with the circuit terminal portions forming a circuit between the circuit on the substrate and the IC chip.

23 Claims, 7 Drawing Sheets

STRUCTURE FOR MOUNTING AN INTEGRATED CIRCUIT

BACKGROUND OF THE INVENTION

This invention relates generally to an electronic timepiece and in particular to a structure for mounting an integrated circuit chip in the timeplace.

Electronic timepieces including integrated circuit ("IC") chips are known in the art as disclosed by Japanese Laid Open Application Nos. 59-138341, 56-50544 and 59-120884. In these prior art timepieces the terminals of the IC chip are connected to a circuit wiring pattern by gold wire, welding, and soldering the circuit pattern leads to the IC chip terminals. A molding or bonding agent is used to reinforce the connection between the IC chip and the circuit leads.

These prior art connections have been satisfactory however they are disadvantageous in that they require an extra step of welding, soldering or connecting a gold wire in order to connect the IC chip to the circuit pattern. Additionally, such a process is irreversible, making it impossible to remove the IC chip for replacement or repair without removing the entire circuit pattern. Furthermore, since the IC chip and the circuit board to which it is attached are two of the more expensive components of a timepiece, removing the entire circuit block for repair increases the cost of repair.

Accordingly, it is desirable to provide a structure for mounting the IC chip which overcomes the shortcomings of the prior art device described above.

SUMMARY OF THE INVENTION

Generally speaking, in accordance with the invention, an improved structure for mounting an IC chip in an electronic timepiece is provided. An insulating circuit substrate having a wiring pattern formed thereon is mounted on a frame. The IC chip is mounted in a positioning hole or on the circuit substrate. A circuit block cover formed with a biasing member is disposed over the IC chip to bias the chip terminals against the circuit pattern to insure electrical contact without welding or soldering.

It is an object of this invention to provide an improved structure for mounting an IC chip within an electronic timepiece.

Another object of the invention is to provide a structure for mounting an IC chip within a timepiece which does not require welding, soldering or extra gold wire.

A further object of this invention is to provide a structure for mounting an IC chip within an electronic timepiece which allows the IC chip to be replaced easily.

Yet another object of this invention is to provide a structure for mounting an IC chip which reduces the cost of repair and replacing the IC chip within the timepiece.

Still other object and advantages of the invention will in part be obvious and in part be apparent from the specification and drawings.

The invention accordingly comprises features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is made to the following description taken in connection with the accompanying drawings in which.

DESCRIPTION OF THE PREFERRED EMBODIMENTS

Figure 1:
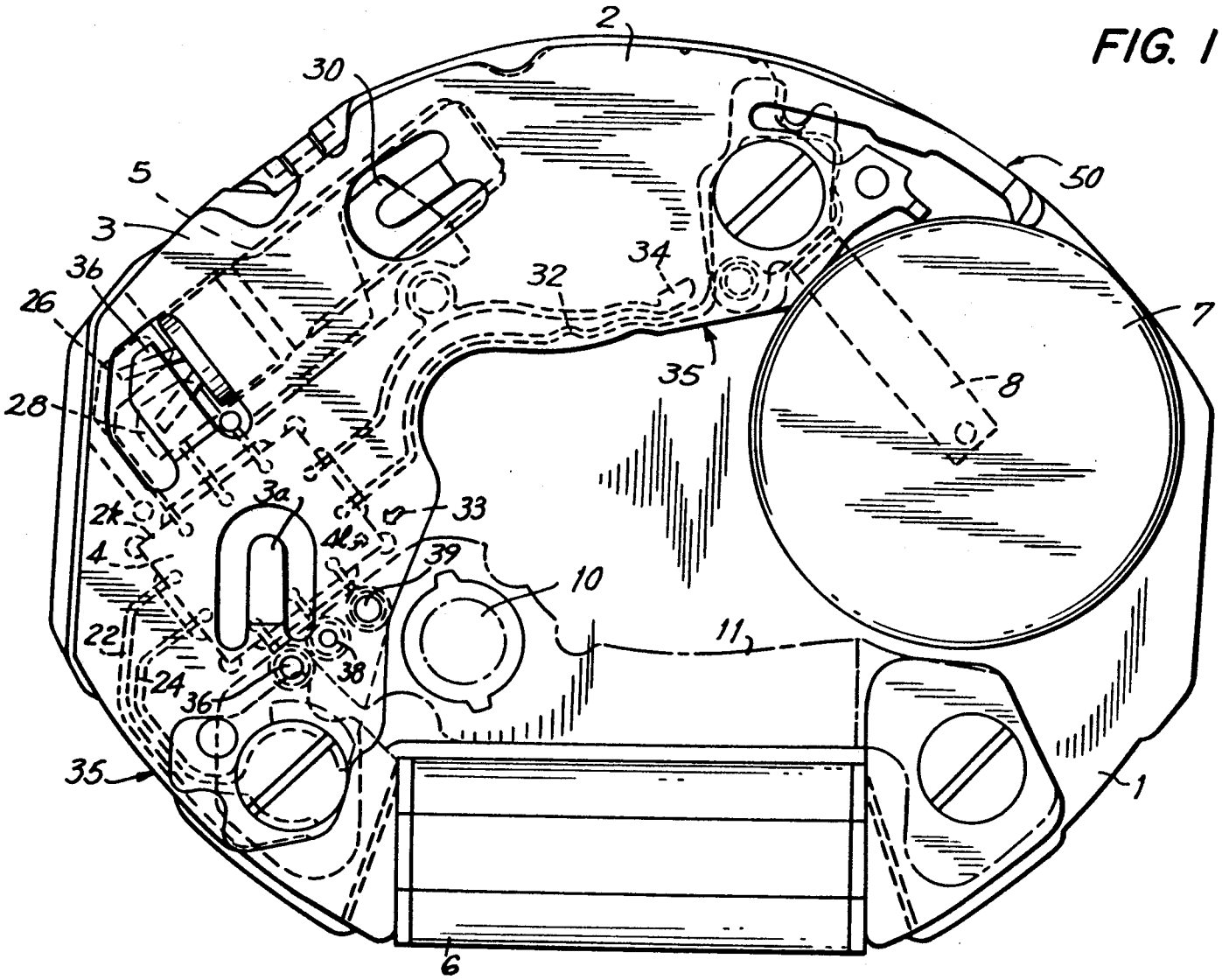
FIG. 1 is a plan view of an electronic timepiece wherein an IC chip is mounted therein in accordance with the invention.
Figure 2:
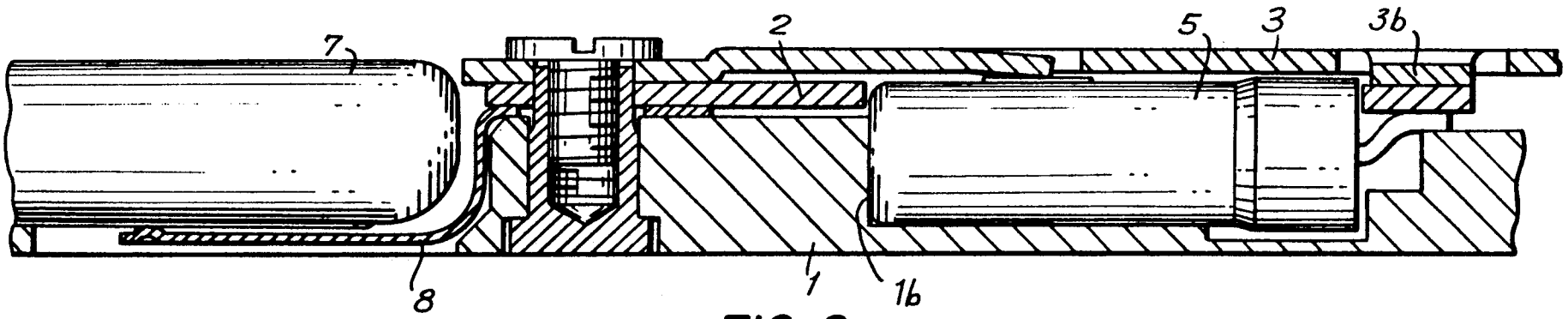
FIG. 2 is a cross-sectional view of a portion of the timepiece; of FIG. 1 showing a portion of the timepiece of FIG. 1 showing mounting of the battery and oscillator.
Figure 3:
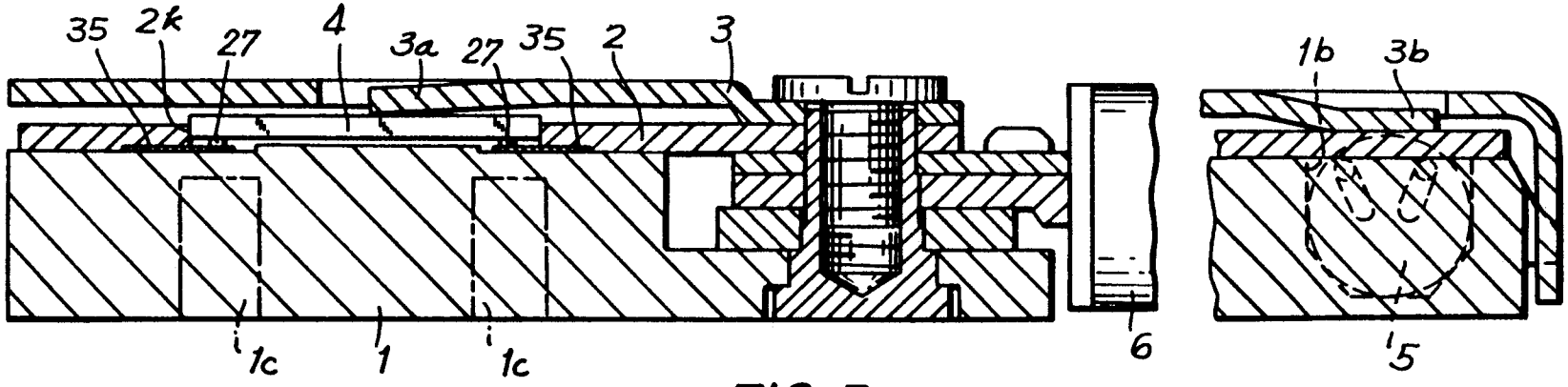
FIG. 3 is a cross-sectional view of a portion of the timepiece of FIG. 1 showing mounting in accordance with the invention.

FIGS. 1–3 illustrate a structure for supporting an IC chip in accordance with the invention. An electronic timepiece, generally indicated as 50, includes a plate 1 formed of a synthetic non-conductive resin which is a frame for supporting various components of timepiece 50. An insulated circuit board 2 is mounted on plate 1 and supports a circuit pattern, generally indicated as 35 which is the circuit. Circuit board 2 is formed with a positioning hole **2*k* for receiving IC chip 4 releasibly secured therein. IC chip 4 is tension fit in hole 2*k* for preventing movement of IC chip 4 in any direction parallel to circuit board 2**.

Electronic timepiece 50 is powered by a battery 7 supported within plate 1 and electrically coupled to circuit board 2 by a negative terminal 8 which contacts the cathode of battery 7. A quartz crystal oscillator 5 is positioned within a cavity 1*b* formed in plate 1. A time display (not shown) of an analog electronic timepiece is controlled by a step motor 6 mounted in plate 1. Step motor 6 includes a rotor 10, an stator 11, a permanent magnet (not shown) and a pinion (not shown).

IC chip 4 has raised projecting terminals 27 for connecting the electronic circuit elements of IC chip 4 to circuit pattern 35. Respective terminals 27 control step motor 6, oscillator 5, a reset terminal, a $V_{DD}$ terminal, a $V_{SS}$ terminal and a test terminal 4*l* for detection with an IC itself. Circuit pattern 35 includes pattern elements 22 and 24 for connecting step motor 6 to corresponding terminals 27 of IC chip 4, and a gate pattern 26, a drain pattern 28, a $V_{DD}$ pattern 30, a $V_{SS}$ pattern 32 and a resetting pattern 34. Elements 22, 24 corresponds to output terminals 01, 02 of step motor 6. A pair of test patterns 36 and 38 and an input terminal 39 for writing are also formed as part of circuit pattern 35. Each of patterns 22, 24, 26, 28, 30, 32, 34, 36 and 38 extend at one end into positioning hole 2*k* so that the lead ends of each pattern comes in contact with corresponding terminal 27 of IC chip 4. Circuit board 2 is mounted on plate 1 in facing relationship with circuit pattern 35 being disposed between circuit board 2 and plate 1. Circuit pattern 35 is provided with a gilt finish.

IC chip 4 is positioned within positioning hold 2*k* by a force fit along the sides of IC chip 4 and by avoiding pressure at the corners of IC chip 4. This prevents planar displacement of IC chip 4. Vertical displacement of IC chip 4 is avoided by a spring 3*a* formed on circuit block corner 3 with raised terminals 27 contacting circuit pattern 35. Since plate 1 is formed of a synthetic resin, it is slightly flexible and absorbs any downward movement in position of terminal 27. If cut out portions shown as 1*c* are formed, flexibility of plate 1 increases, thereby improving the electrical contact between terminals 27 and circuit pattern 35.

In an exemplary embodiment, an arrow 33 is provided on circuit board 2 to indicate where test terminal 4*l* should be positioned. Accordingly, IC chip 4 is always place din the proper orientation to come in contact with the appropriate leads of circuit pattern 35.

Failures in the mounting process are avoided because application of heat and pressure in wire bonding is avoided by securing the IC chip within the circuit board by leafspring portion 3*a* of circuit block cover 3. This make repair and replacement less costly and easier to accomplish. Furthermore, conductivity between the circuit, the oscillator and the IC chip is obtained through contact pressure rather than external elements such as solder, weld or gold wiring providing a better conductive contact which is also less subject to breakdowns. Oscillator 5 is similarly pressed by a leafspring portion 3*b* formed in cover 3 above cavity 1*b*. Accordingly, circuit block cover 3 acts as a press member positioning the IC chip 4 and oscillator 5 in proper position.

Terminals 27 may vary in height. Therefore, it is desirable for portions of circuit pattern 35 or plate 1 to absorb terminal 27 to effect an even contact height ensuring contact of each terminal 27 with the corresponding portion of circuit pattern 35. FIGS. 4–9 illustrate alternative embodiments to ensure electrical contact between terminal 27 and circuit pattern 35. In each of the embodiments, like elements are references by like numerals as the first embodiment discussed above.

Figure 4:
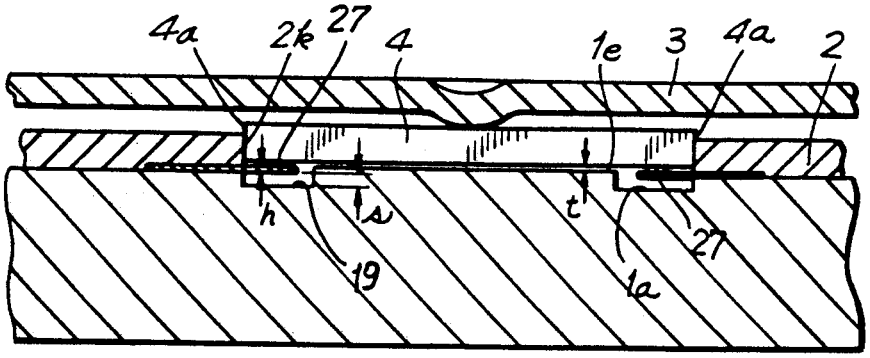
FIG. 4 is a cross-sectional view of a third embodiment of a structure for mounting an IC chip in accordance with the invention.

In FIG. 4 a recess is formed at approximately the same position at each terminal 27 of IC chip 4. Since there is variation in height h of gold terminal 27 a portion of pattern 35 is deflected to absorb this variation in height. A recess 1*a* is formed below the contacting portion of pattern 35 opposite to terminals 27 providing a clearance s below circuit pattern 35. Preferably, terminal height h is greater than clearance s. Additionally, a notch between the bottom surface of IC chip 4 and the top surface of plate 1 is shown in FIG. 4 as 1*e* and clearance t of notch 1*e* is also greater than clearance s. Accordingly, good conductive contact is obtained between circuit pattern 35 and terminals 27 of IC chip 4.

Circuit block cover 3 is also formed with a detent 3*c* which contacts IC chip 4 when cover 3 is mounted on plate 1. Due to the elastic properties of cover 3, detent 3*c* provides a downwardly biasing force upon IC chip 4 to secure IC chip 4 against circuit pattern 35. IC chip 4 may be formed with a projecting edge 4*a* along the surface to maintain IC chip 4 above the height of circuit board 2.

Figure 5:
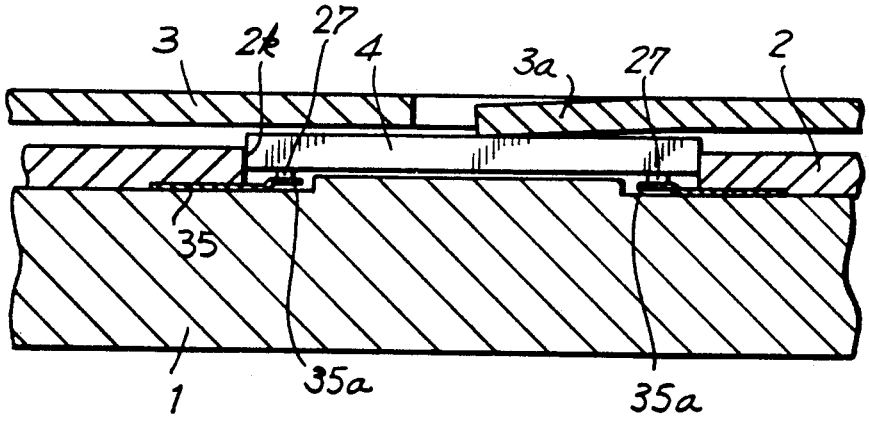
FIG. 5 is a cross-sectional view of a third embodiment of a structure for mounting an IC Chip in accordance with the invention.

FIG. 5 illustrates an embodiment in which end portions 35*a* of circuit pattern 35 are bent to provide a clearance therebetween and plate 1. Again, as in the embodiment of FIG. 4 each end portion 35*a* of circuit pattern 35 is flexible and can be deflected so that each terminal end portion 35*a* contacts corresponding terminal 27 of IC chip 4 allowing for variations in terminal 27 height as well as providing good conductive contact.

Figure 6:
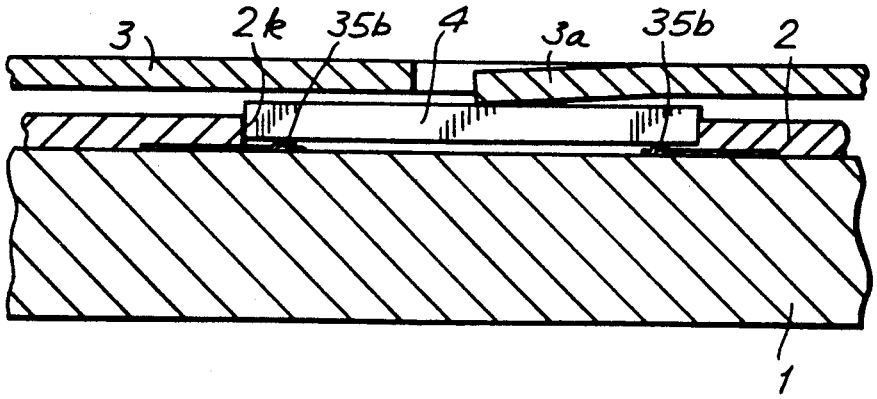
FIG. 6 is a cross-sectional view of a fourth embodiment of a structure for mounting an IC chip in accordance with the invention.
Figure 9:
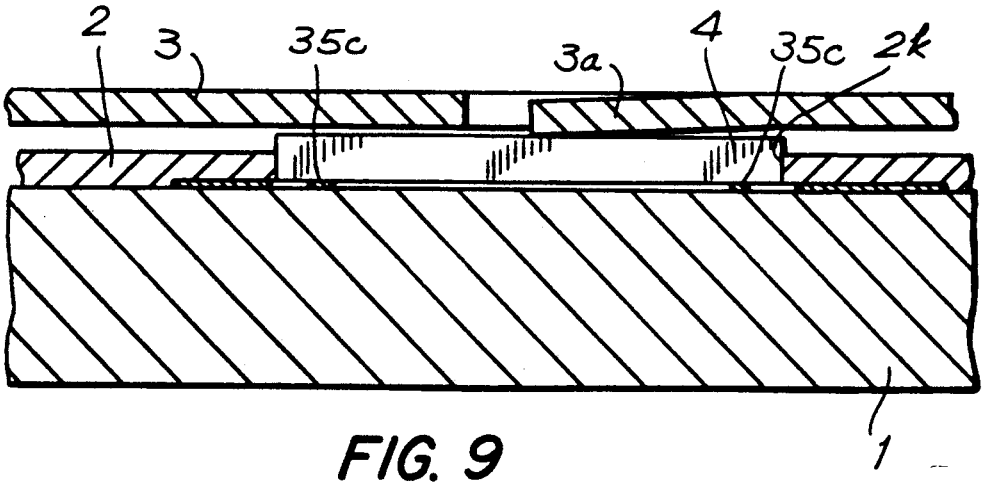
FIG. 9 is a cross-sectional view of a seventh embodiment of a structure for mounting an IC chip in accordance with the present invention.

In the embodiments shown in FIGS. 6 and 9 terminals 27 are formed flush with the bottom surface of IC chip 4. In order to provide a contact between circuit pattern 35 and IC chip 4, circuit pattern end portions 35*b* are formed with a raised projection which contacts terminals 27 of IC chip 4. Projecting end portions 35*b* may be formed either as a raised bump as shown in FIG. 6 or by etching one portion of circuit pattern 35 to form a circuit end portion 35*c* shown in FIG. 9.

Figure 7:
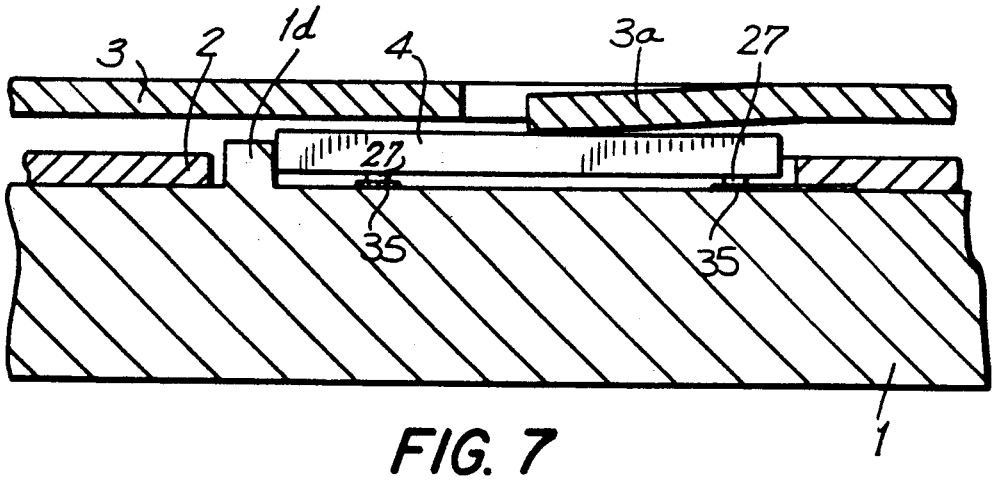
FIG. 7 is a cross-sectional view of a fifth embodiment of a structure for mounting an IC chip in accordance with the present invention.

In FIG. 7 IC chip 4 is secured in a direction parallel to circuit substrate 2 within positioning hole 2*k* by a series of projections 1*d* extending from plate 1. Terminals 27 are connected in the same manner as described above. A circuit seat formed of a synthetic resin may be used in place of plate 1.

Figure 8:
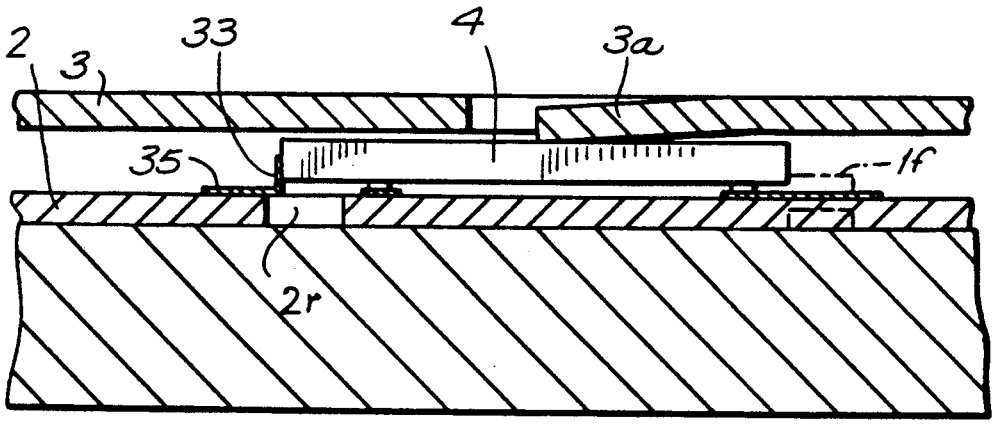
FIG. 8 is a cross-sectional view of a sixth embodiment of a structure for mounting an IC chip in accordance with the present invention.

In FIG. 8 IC chip 4 is supported above circuit board 2 in facing relationship with circuit block cover 3. A pattern lead 33 of circuit pattern 35 having the same potential as $V_{DD}$ or zero potential is bent upwards to contact IC chip 4 at a side and to position IC chip 4 against projection 1*f* formed on plate 1. Lead 33 having the same potential as $V_{DD}$ or an insulator may also be provided to secure IC chip 4 in position. A hole 2*r* is provided in circuit board 2 to form the bend in pattern lead 33. IC chip 4 is prevented from moving in a direction parallel to plate 1 by pattern lead 33 and prevented from moving up and down by projection 3*a*. Furthermore, the embodiment of FIG. 8 may be accomplished by using any of the electrical contact methods of the embodiments described above.

Figure 10:
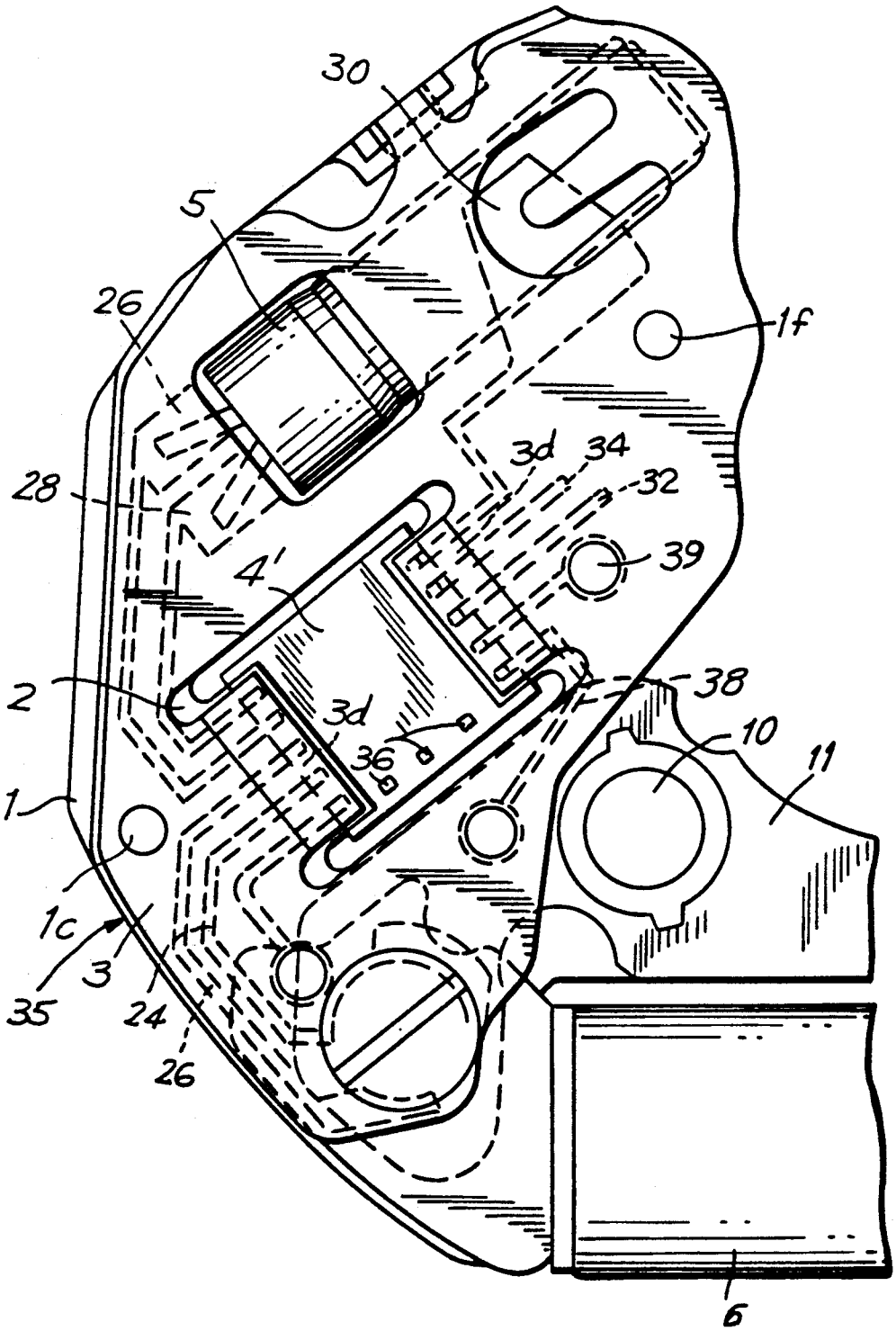
FIG. 10 is a plan view of a circuit block of an electronic timepiece showing a structure for mounting an IC chip in accordance with another embodiment of the invention.
Figure 11:
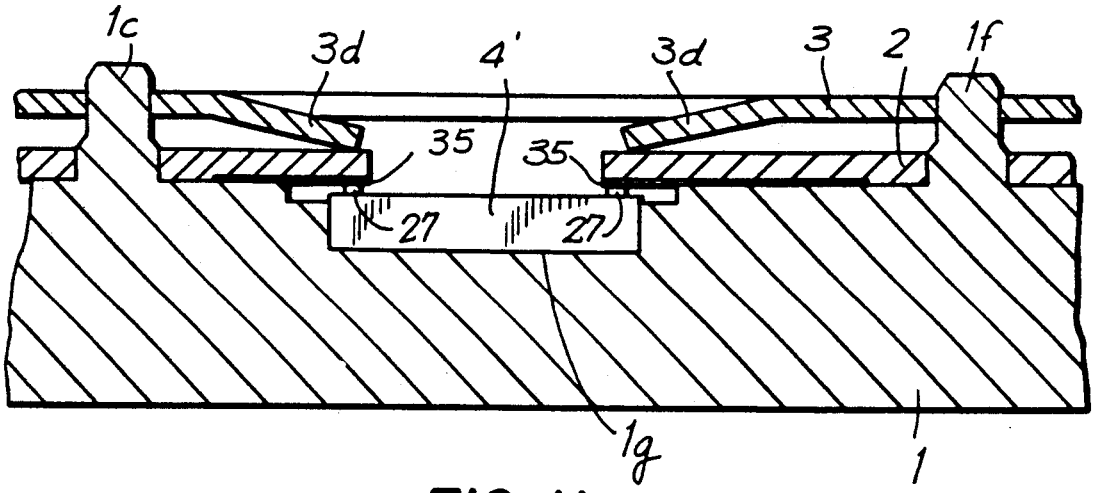
FIG. 11 is a cross-sectional view of the structure for mounting the IC chip in the circuit block of FIG. 10.

FIGS. 10 and 11 illustrate an alternative embodiment for mounting the IC chip in which a recess 1*g* is formed in synthetic resin plate 1 for receiving an IC chip 4'. IC chip 4' includes all the terminals of IC chip 4 of FIG. 1 as well as test terminals 36. As test terminals, they remain uncovered by cover block 3 and substrate 2. IC chip 4' is mounted by tension fit within recess 1*g* to prevent movement of IC chip 4' in a direction parallel to plate 1. Projections 1c and 1f are integrally formed on plate 1 and circuit board 2 is mounted thereon and extends across recess 1g so that terminals 27 come into contact with circuit pattern 35. Circuit block cover 3 is formed with an opposed pair of downwardly facing leafspring projections 3d which bias circuit board 2 against IC chip 4 to provide good electrical contact between terminals 27 and circuit pattern 35.

Circuit board 2 is positioned between leafsprings 3d of cover 3 and circuit pattern 35, providing an insulating layer preventing short circuits. Furthermore, the above embodiment depicts only two leafsprings 3d, however, the above embodiment may be adapted to utilize more than two leafsprings, for example providing four leafsprings one at each corner of the IC chip or providing each terminal 27 with a corresponding individual leafspring to provide the pressure to ensure good conductive contact.

As discussed above, IC chip 4 can be easily inserted into timepiece 50 by placing IC chip 4 within recess 1g with circuit board 2 on plate 1 so that pattern 35 comes in contact with terminals 27 and cover plate 3 is mounted on plate 1 and secured by screws or the like. After this assembly is complete, operational checks are performed and timing rate adjustments are made. The complete timeplace is assembled by positioning each part so that assembly is readily accomplished. Furthermore, because the necessity for soldering, welding or other like bonding has been eliminated, the opportunity for destroying the IC chip during installation is reduced and quick repair and replacement of the IC chip are made possible if it is defective.

Figure 12:
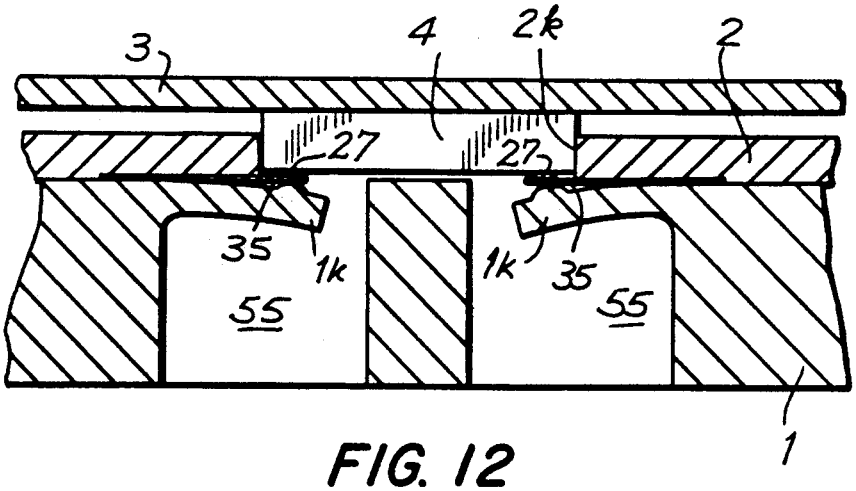
FIG. 12 is a cross-sectional view of a of a structure for supporting an IC chip in accordance with the invention.
Figure 13:
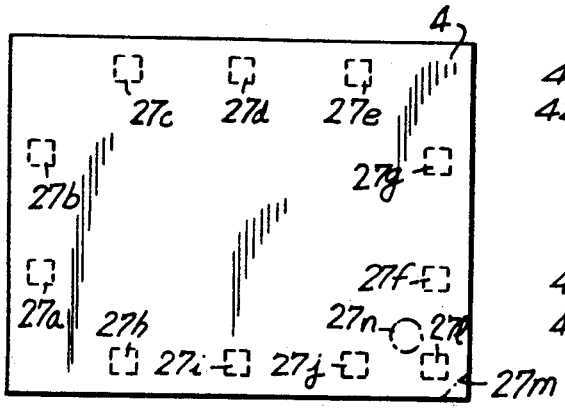
FIG. 13 is a bottom plan view of an IC chip suitable for mounting in the structure of FIG. 1.

FIG. 12 depicts an embodiment in which plate 1 is formed with an inwardly projecting flange 1k formed over a cavity 55 with a central support projection 1j. Flange 1k extends below positioning hold 2k overlapping positioning hold 2k so that terminals 27 contact circuit pattern 35. Circuit block cover 3 is mounted on plate 1 and IC chip 4 is positioned between flange 1k and cover 3 within hold 2k positioned on support projection 18. Flange 1k acts to bias the leads of circuit pattern 35 against terminals 27. Plate 3 is mounted to apply a downward force on IC chip 4 towards the leads of circuit pattern 35 and IC chip 4.

The mounting of IC chip 4 in this embodiment may also be accomplished without circuit board 2. In this case circuit pattern 35 may be formed on plate 1 and the positioning of IC chip 4 is accomplished by projections as in FIG. 7. Furthermore, in the above embodiments the conductivity of the terminal 27 of IC chip 4 and circuit pattern 35 is made possible by biasing forces of elements functioning as leaf springs. However, it is possible to use elastic members such as a coil spring or the like to bring circuit pattern 35 in contact with terminals 27.

Reference is now made to FIGS. 13–16 which are plan views of IC chips showing how the proper position of the IC chip is provided. IC chip 4 in FIG. 13 has terminals 27 provided about its periphery in a substantially mirror-like fashion. Output terminals 27a and 27b for the stepping motor are provided at one side, oscillator terminals 27c, 27d and $V_{DD}$ terminal 27e provided on a second side. Test terminals 27h, 27i, 27j are positioned opposite oscillator terminals 27c, 27d, 27a. Similarly, $V_{SS}$ terminal 27f and reset terminal 27g are positioned on the side opposite terminals 27a, 27b. Each lead wire of circuit pattern 35 must come into contact with an appropriate terminal 27. Thus, it is necessary to orient IC chip 4 relative to circuit pattern 35 for proper operation of the timepiece. Accordingly, test terminal 27l is placed at the corner adjacent terminal 27f so that the side containing terminals 27f, 27g may be differentiated from the side containing terminals 27a, 27b. Looking at the active surface of IC chip 4 enables one to ascertain the proper orientation of IC chip 4. Furthermore, a differentiated face 27m ;may be provided at one corner or a mark 27n may be provided on the non-active surface of IC chip 4 to aid further in identifying the orientation of IC chip 4.

Figure 14:
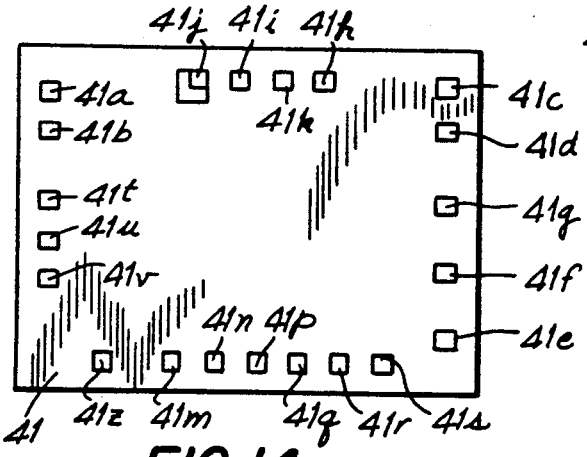
FIG. 14 is a bottom plan view of another IC chip suitable for mounting in a structure in accordance with the invention.

A plan view of the active surface of an IC chip 41 is shown in FIG. 14. Again, a series of terminals are provided about the periphery of IC chip 41. Terminals 41a, 41b are the output terminals for controlling step motor 6. Terminals 41t, 41u, and 41v for adjusting the timing rate are positioned on the same side as terminals 41a, 41b and are separated from the terminals 41a, 41b by a distance greater than the distance separating terminals 41t from 41u from 41v. Oscillator terminals 41c and 41d are positioned at a side opposite terminals 41a, 41b. Reset terminal 41e, $V_{DD}$ terminal 41f and $V_{SS}$ terminal 41g are positioned on the same sides as terminal 41c, 41d opposite terminals 41t, 41u, 41v but spaced apart a greater distance than terminals 41t, 41u, 41v. Test terminals 41h, 41i, 41j of IC chip 41 and test terminal 41k for monitoring the circuit block are positioned at a third side. Terminals 41m, 41n, 41k, 41q, 41r, and 41s for regulating the logic systems and test terminal 41z for monitoring the logic systems are positioned on the fourth side of IC chip 41 opposite terminals 41i, 41k, 41h. The orientation of IC chip 41 may be determined by various methods. The distance between various terminals 41g, 41f and 41e ;may be compared with the distance between terminals 41t, 41u, 41v. The number of terminals on the side of IC chip 41 containing terminals 41j, 41i, 41k and 41h is less than the number of terminals on the opposite side. Furthermore, terminal 41j may be made larger than the remaining terminals as marked with the thin line.

Figure 15:
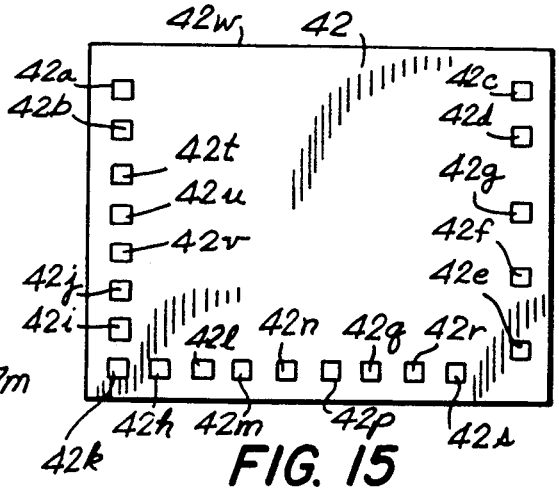
FIG. 15 is a bottom plan view of a further IC chip suitable for mounting in a structure in accordance with the invention.

FIG. 15 illustrates an IC chip 42 similar to the IC chip used in the mounting structure of FIGS. 10 and 11. Since no terminals are formed at side 42w of IC chip 42, orientation of of the IC chip is accomplished by referencing the leads for the terminal to clear side 42w.

Figure 16:
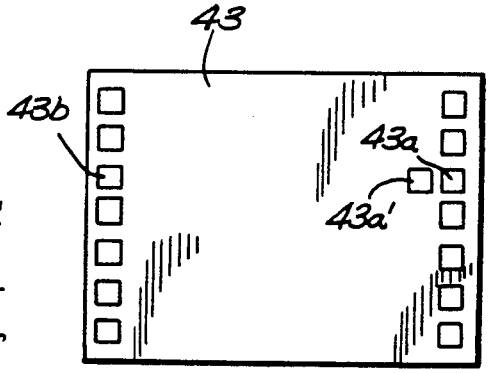
FIG. 16 is a bottom plan view of yet another IC chip suitable for mounting in a structure constructed in accordance with the invention.

FIG. 16 illustrates an IC chip 43 in which each terminal is located on either of two opposing sides. Terminal 43a is formed of gold or of a different material than terminal 43a' formed of solder so that by visual inspection one may discern orientation by the pattern of colors and materials of terminals 43. Further, it is also possible to determine from the layout of the terminals the position, size or shape of certain terminals to determine the orientation of the IC chip. Furthermore, height variations of the terminals may also be used much in the same way as other variations to orient the IC chip. One terminal 43a may be located at an inner location from the other terminal to aid in locating project orientation.

Accordingly, by providing a mounting structure for an IC chip wherein the IC chip terminals are pressed against the circuit pattern for the timepiece to obtain electrical conductivity, both assembly and repair are enhanced. Additionally, since it is no longer necessary to bond, weld or solder the IC chip to the circuit, the residue of products is eliminated, omitting the necessity to clean the IC chip after mounting. Furthermore, since the IC chip is not permanently joined to the circuit, it is impossible to replace the IC chip easily, thereby saving labor, time and money. Furthermore, while providing a pattern on the IC chip that aids in orienting the IC chip to the circuit board pattern, assembly becomes easier preventing error in assembly and repair becomes easier. Additionally, since the contact voltage at the contact between the IC chip terminal and the circuit pattern is increased, the reliability of the conductivity is also increased.

It will thus be seen that the objects set forth above among those made apparent from the preceeding description, are efficiently attained and since certain changes may be made in the above construction without departing from the spirit and scope of the invention it is intended that all matter contained in the above description or shown in the accompanying drawings shall be interpreted as illustrative and not in a limiting sense.

It is also to be understood that the following claims are intended to cover all generic and specific features of the invention herein described and all statements of the scope of the invention which as a matter of language, might be said to fail therebetween.

What is claimed is:

1. A structure for mounting an integrated circuit chip ("IC chip") having a plurality of chip terminals within a timepiece, comprising:

a timepiece frame;

an insulating circuit substrate supported on the frame and formed with a chip receiving opening for receiving and positioning the IC chip in the plane of the substrate;

a circuit pattern having circuit terminal portions formed as leaf springs selectively formed on the circuit substrate overhanging within said chip receiving opening, the circuit terminal portions being adapted to contact corresponding chip terminals when the IC chip is mounted on the circuit substrate; and biasing means for biasing one of the IC chip or circuit terminal portions towards each other so that the chip terminal portions come into conductive contact with the circuit terminal portions for forming a circuit between the circuit pattern and the IC chip, whereby the IC chip is supported between the frame and the biasing means without the need for adhesives or additional containment structure.

2. The mounting structure of claim 1, wherein a projecting member is formed on one of the chip terminal portions or corresponding circuit terminal portions.

3. The mounting structure of claim 1, further comprising securing means for preventing movement of the IC chip in a direction substantially parallel to the frame.

4. The mounting structure of claim 1, wherein the biasing means includes a cover plate disposed over at least a portion of an IC chip mounted on the circuit substrate, the cover plate including a leaf spring portion overlapping the IC chip in plan view to bias the IC chip terminals on the circuit terminal portions.

5. The mounting structure of claim 1, wherein the circuit terminal portion which contacts the chip terminals is flexible.

6. The mounting structure of claim 1, wherein the frame is substantially planar and is formed with at least one recess extending below the terminals of an IC ship mounted on the circuit substrate and the portion of the circuit pattern that comes into contact with the chip terminals extends into the recess and the terminals of the IC chip extend into the recess to contact the circuit pattern.

7. The mounting structure of claim 5, wherein the flexible portion of the circuit terminal portions are bent and the bent portions contact the chip terminals.

8. The mounting structure of claim 1, wherein the substrate is formed with a chip receiving opening for receiving and securing the IC chip therein by a tension fit and the circuit terminal portions extend into the opening to overlap the chip terminals in plan view.

9. The mounting structure of claim 1, wherein the substrate is formed with a chip receiving opening for receiving and securing the IC chip therein by a tension fit, the circuit substrate and circuit terminal portion overlap and contact the chip terminal portions.

10. The mounting structure of claim 3, wherein the securing means is a circuit block cover which includes a portion inclined towards an IC chip mounted on the circuit substrate, the inclined portion extending over at least one side of the IC chip, for biasing the chip towards the circuit pattern.

11. The mounting structure of claim 8, wherein the frame is formed with a cavity opposed to the position of the IC chip, from the cavity having an inwardly projecting flange over the cavity and extending below the chip, the flange formed with a projecting region so that the flange biases the circuit terminal portions towards the chip terminals, and a cover plate mounted on the frame so that the IC chip is supported between the cover plate and the flange.

12. The mounting structure of claim 8, further including a chip support post formed in the cavity in the frame.

13. The mounting structure of claim 1, wherein the frame is formed of a conductive member and includes an insulating layer formed on the surface of the frame opposed to the circuit substrate.

14. The mounting structure of claim 1, further including means for indicating the proper orientation of the IC chip.

15. The mounting structure of claim 14, wherein the indication means includes an indicia on the IC chip at a predetermined position.

16. The mounting structure of claim 14, wherein the IC chip has four sides and the indication means includes providing equal numbers of terminals at two opposed sides and at least one more terminal on one of the sides of the remaining pair of the sides.

17. The mounting structure of claim 15, wherein the indicia is one terminal of a different size than the remaining terminals, the remaining terminals being of the same size.

18. The mounting structure of claim 15, wherein the indicia is at least one terminal formed of a material having a different color than the remaining terminals.

19. The mounting structure of claim 14, wherein the IC chip has four sides and the indicating means consists of providing terminals on three sides of the IC chip.

20. The structure for mounting an integrated circuit chip of claim 1, wherein said frame is flexible.

21. A structure for mounting an integrated circuit chip ("IC chip") having a plurality of chip terminals within a timepiece, comprising:

a timepiece frame;

an insulating circuit substrate supported on the frame, formed with a chip receiving opening for receiving and securing the IC chip in the plane of the substrate by tension fit;

a circuit pattern having circuit terminal portions formed as leaf springs selectively formed on the circuit substrate adapted to overhang within said chip receiving opening to contact corresponding chip terminals when the IC chip is mounted on the circuit substrate; ;and biasing means for biasing one of the IC chip or circuit terminal portions towards each other so that the chip terminal portions come into conductive contact with the circuit terminal portion forming a circuit between the circuit pattern and the IC chip, whereby the IC chip is supported between the frame and the biasing means without the need for adhesives or additional containment structure.

22. The mounting structure of claim 20, wherein the biasing means is a circuit block cover which includes a portion inclined towards an IC chip mounted within the circuit substrate.

23. The mounting structure of claim 21, wherein the integrated circuit chip includes indication means for indicating proper orientation of the integrated circuit chip when the integrated circuit is mounted in the mounting structure.

* * * * *